US012234722B2

(12) United States Patent
Hough et al.

(10) Patent No.: US 12,234,722 B2
(45) Date of Patent: Feb. 25, 2025

(54) SYSTEMS AND METHODS FOR DOWNHOLE COMMUNICATION

(71) Applicant: Schlumberger Technology Corporation, Sugar Land, TX (US)

(72) Inventors: Steven Hough, Minchinhampton (GB); Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 223 days.

(21) Appl. No.: 17/996,239

(22) PCT Filed: Apr. 15, 2021

(86) PCT No.: PCT/US2021/027424
§ 371 (c)(1),
(2) Date: Oct. 14, 2022

(87) PCT Pub. No.: WO2021/211800
PCT Pub. Date: Oct. 21, 2021

(65) Prior Publication Data

US 2023/0193748 A1 Jun. 22, 2023

(30) Foreign Application Priority Data

Apr. 16, 2020 (GB) ..... 2005561

(51) Int. Cl.
*E21B 47/13* (2012.01)
*E21B 17/02* (2006.01)
*E21B 7/04* (2006.01)

(52) U.S. Cl.
CPC ..... *E21B 47/13* (2020.05); *E21B 17/028* (2013.01); *E21B 7/04* (2013.01)

(58) Field of Classification Search
CPC ..... E21B 47/13; E21B 17/028; E21B 7/04; E21B 17/003
See application file for complete search history.

(56) References Cited

U.S. PATENT DOCUMENTS

2007/0247330 A1* 10/2007 Clark ..... E21B 47/01 340/854.6
2010/0258351 A1 10/2010 Hooks et al.
(Continued)

FOREIGN PATENT DOCUMENTS

WO 2004099556 A1 11/2004
WO 2006093837 A2 9/2006
(Continued)

OTHER PUBLICATIONS

International Search Report and Written Opinion in International Patent Application No. PCT/US2021/027424, dated Jul. 29, 2021, 8 pages.
(Continued)

*Primary Examiner* — Amine Benlagsir
(74) *Attorney, Agent, or Firm* — Jeffrey D. Frantz

(57) ABSTRACT

A downhole communication system includes a gap sub located at an RSS. The gap sub is located on the outer, independently rotating member of the RSS. This allows the RSS to receive electromagnetic downlink communication signals from the surface or from an MWD. The RSS transmits electromagnetic uplink signals to a second gap sub located above the RSS or to the surface.

16 Claims, 7 Drawing Sheets

(56) References Cited

U.S. PATENT DOCUMENTS

| | | | | |
|---|---|---|---|---|
| 2012/0085583 | A1 | 4/2012 | Logan et al. | |
| 2014/0084946 | A1* | 3/2014 | Clark | G01N 27/02 324/654 |
| 2017/0359633 | A1 | 12/2017 | White et al. | |
| 2018/0216457 | A1 | 8/2018 | Derkacz et al. | |
| 2021/0040796 | A1* | 2/2021 | Azar | E21B 17/10 |
| 2022/0120928 | A1* | 4/2022 | Hori | E21B 47/04 |
| 2022/0251949 | A1* | 8/2022 | Maclean | E21B 47/16 |

FOREIGN PATENT DOCUMENTS

| | | | | |
|---|---|---|---|---|
| WO | 2014071520 | A1 | 5/2014 | |
| WO | WO-2015031973 | A1 * | 3/2015 | E21B 17/003 |
| WO | 2015192226 | A1 | 12/2015 | |
| WO | 2016168929 | A1 | 10/2016 | |

OTHER PUBLICATIONS

Combined Search and Examination Report under Sections 17 and 18(3) in GB Patent Application No. GB2005561.2, dated Jan. 21, 2021, 12 pages.

* cited by examiner

SYSTEMS AND METHODS FOR DOWNHOLE COMMUNICATION

CROSS-REFERENCE TO RELATED APPLICATIONS

This application is the National Stage Entry of International Application No. PCT/US2021/027424, filed Apr. 15, 2021, which claims the benefit of, and priority to, U.K. Patent Application No. 2005561.2, filed Apr. 16, 2020 and titled "Systems and Methods for Downhole Communication", which application is expressly incorporated herein by this reference in its entirety.

BACKGROUND

Downhole drilling systems may include many sensors and/or tools. An operator at the surface may communicate with the tools using a variety of communication methods, including pressure pulses, wired drill pipe, wired communication, wireless communication, electromagnetic downlink, and combinations thereof. Electromagnetic uplink and downlink communication systems transmit an electromagnetic signal through a formation to be received at a downhole location.

SUMMARY

In some embodiments, a downhole communication system includes a rotary steerable system ("RSS"). The RSS includes an outer member, an independently rotating inner member, and a gap sub located on the outer member. In some embodiments, the downhole communication system includes two gap subs. The first gap sub is located on the drill string above the RSS, and the second gap sub is located on the RSS.

In some embodiments, a method for downhole communication includes transmitting an electromagnetic signal downhole from a surface location. An electromagnetic signal is received at a first gap sub, and the electromagnetic signal is received at a second gap sub located at an outer member of an RSS.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

This disclosure generally relates to devices, systems, and methods for electromagnetic uplink and/or downlink communication. A downhole communication system may include two gap subs. A first gap sub may be located at a communication tool, such as an MWD. A second gap sub may be located at an RSS. An electromagnetic ("EM") downlink signal transmitted from the surface may be received at one or both gap subs. For example, the EM signal may be received directly at the RSS. In some examples, the EM signal may be received by the gap sub at the MWD, which may relay the EM signal wirelessly to be received at the gap sub at the RSS. In this manner, the EM signal may be received at the RSS, thereby enabling the surface to communicate with the RSS. Communication with the RSS may allow the RSS to receive direction and/or information from the surface, which may help improve directional drilling of the RSS.

Figure 1:
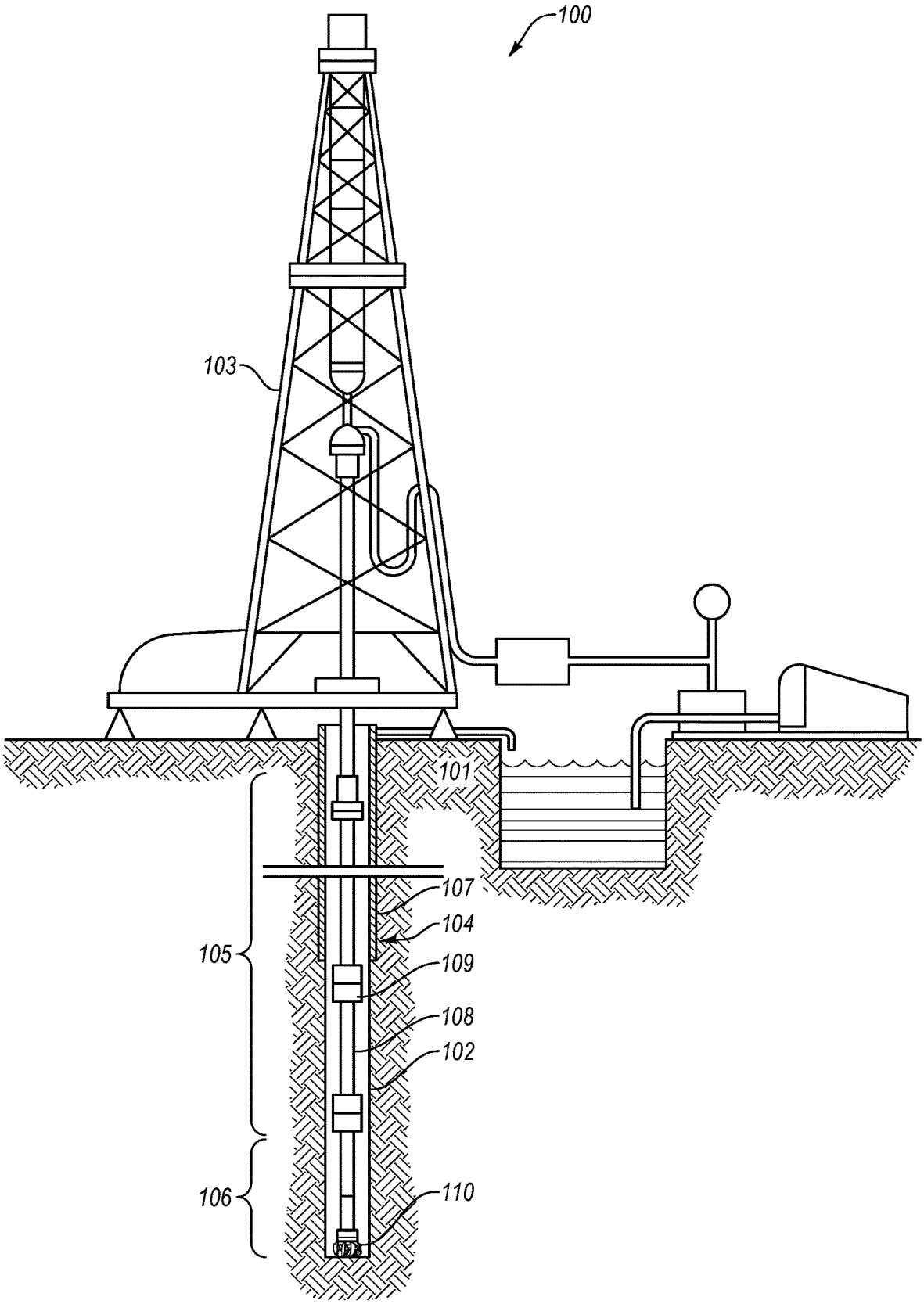
FIG. 1 is a schematic representation of a downhole drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, with the bit 110 attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include an RSS. The RSS may include directional drilling tools that change a direction of the bit 110, and thereby the trajectory of the wellbore 102. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
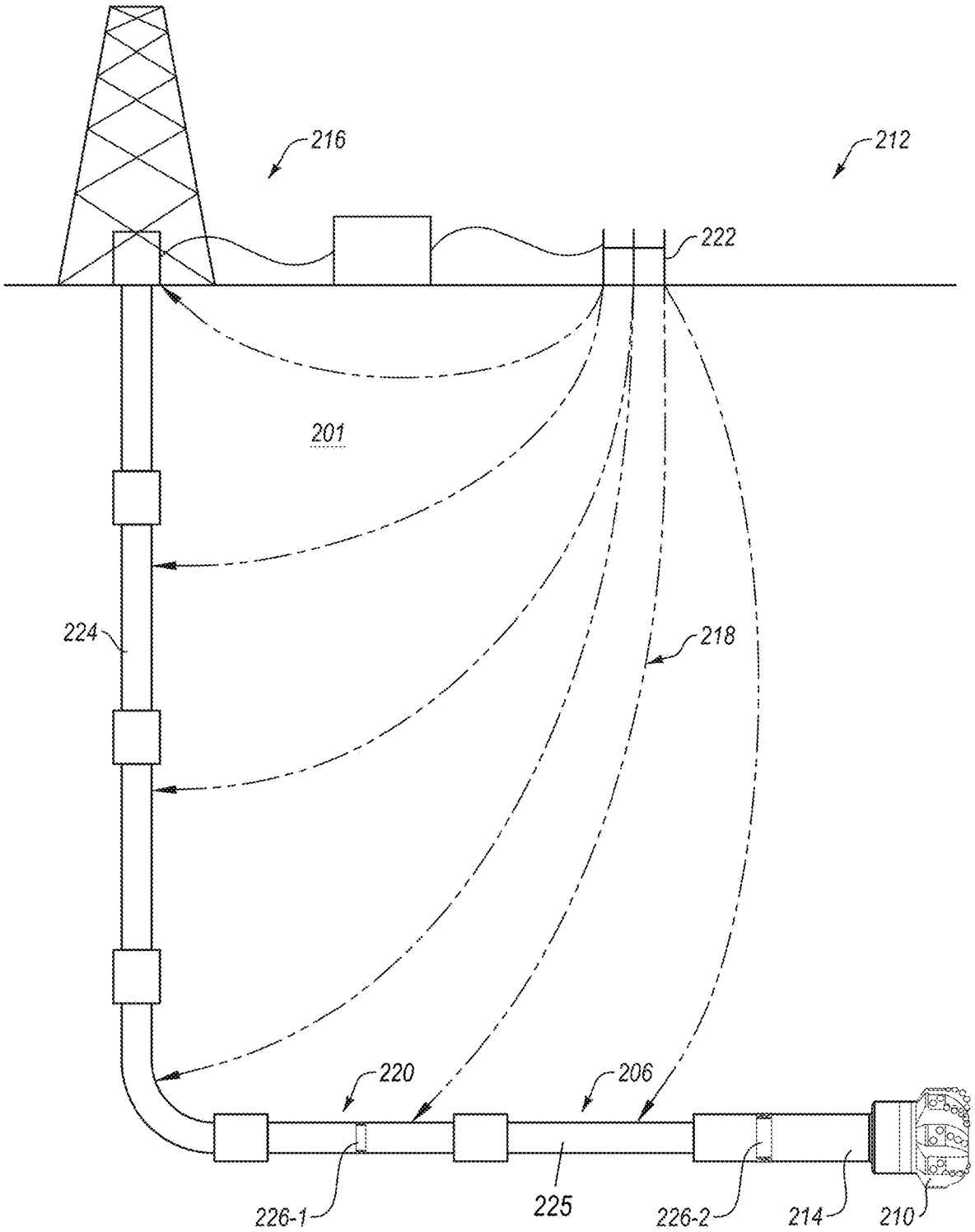
FIG. 2 is a schematic representation of an electromagnetic downlink communication system, according to at least one embodiment of the present disclosure.

FIG. 2 is a schematic representation of a downhole drilling system 212, according to at least one embodiment of the present disclosure. The downhole drilling system 212 includes a BHA 206. The BHA 206 may include one or more downhole tools, such as drill bits, reamers, mills, casing cutters, other downhole tools, and combinations thereof. In some embodiments, the BHA 206 includes one or more MWD and/or LWD tools. The MWD and/or the LWD may include one or more sensors used to measure borehole and/or BHA properties.

In some embodiments, an operator at a surface location 216 may desire to communicate with the BHA 206. For example, the operator may desire to send instructions to one or more downhole tools of the BHA 206. In some embodiments, these instructions may include directions for directional drilling, instructions for a sensor to perform a measurement, instructions to actuate an expandable tool, other downhole instructions, and combinations thereof.

To communicate with the BHA 206 from the surface, a signal 218 may be sent from the surface location 216 to the BHA 206. Communication methods may include one or more of mud pulse generation, wired electromagnetic communication, wireless electromagnetic communication (e.g., electromagnetic downlink), RFID tags sent through the drilling fluid, drop balls, other communication methods, and combinations thereof. In some embodiments, communication method may communicate at a high bit rate (e.g., greater than 1 bits per section, greater than 3 bits per section, greater than 5 bits per section, greater than 10 bits per section) without wired communication and/or a wired drill pipe. In other words, wireless downhole communication, including non-wired downhole communication, may communicate at a high bit rate.

In some embodiments, electromagnetic downlink to the BHA 206 may include one or more transmitters 222 on the surface (such as metal stakes driven into the ground). An EM signal 218 may be transmitted into the formation 201 through the transmitters 222. The EM signal 218 may travel through the formation 201. At least a portion of the EM signal 218 may be collected by a length of drill pipe 224 in a wellbore. The EM signal 218 may travel through the length of drill pipe 224 to a gap sub (collectively 226) in the length of drill pipe 224. The gap sub 226 may be located anywhere along the length of drill pipe 224. For example, the gap sub 226 may be located at or near the BHA 206.

The gap sub 226 includes a section of insulating material (e.g., a material having a high impedance) separating two sections of drill pipe 224. The electric potential across the gap sub 226 may be measured. Because the EM signal 218 travels along the length of the drill pipe 224, the EM signal 218 may be received at the gap sub 226 by recording the electric potential across the gap sub 226. The EM signal 218 may then be demodulated at the BHA 206 and the information encoded in the EM signal 218 retrieved.

In some embodiments, the downhole drilling system 212 may include a first gap sub 226-1 located at a first location in the BHA 206. For example, the first gap sub 226-1 may be located at an MWD 220. In some examples, the first gap sub 226-1 may be located uphole of the MWD 220 (e.g., further up the length of drill pipe 224 toward the surface location 216). In some embodiments, the MWD 220 may be a communication relay station, that only includes the first gap sub 226-1, a way to measure electric potential across the gap sub, and a communication module, such as an EM generator, a pressure/flow rate pulse generator, or other communication module.

In some embodiments, the BHA may include an RSS 214. The RSS 214 may be located adjacent to the bit 210. In some embodiments, the RSS 214 may include a second gap sub 226-2. At least a portion of the EM signal 218 may be collected along a second length of drill pipe 225 between the first gap sub 226-1 and the second gap sub 226-2. The second length of drill pipe 225 may include one or more downhole tools of the BHA 206, including the MWD 220, or the casing or collar of the MWD 220. The second length of drill pipe 225 may pick up the EM signal 218. The EM signal 218 may travel through the second length of drill pipe 225 to the second gap sub 226-2. The electrical potential across the second gap sub 226-2 may be measured, and the EM signal 218 may be received and decoded. In this manner, an operator at the surface location 216 may communicate directly with the RSS 214. In this manner, the operator may provide the RSS 214 with directional drilling instructions, survey information, instructions to perform measurements using sensors on the RSS, and other information. As will be discussed herein, in some embodiments, both the first gap sub 226-1 and the second gap sub 226-2 may receive the EM signal 218. In some embodiments, the EM signal 218 may be received at the first gap sub 226-1 and relayed to the RSS 214 using any communication mechanism, including EM downlink, pressure/flow rate pulses, wired communication, and other communication mechanisms.

Figure 3:
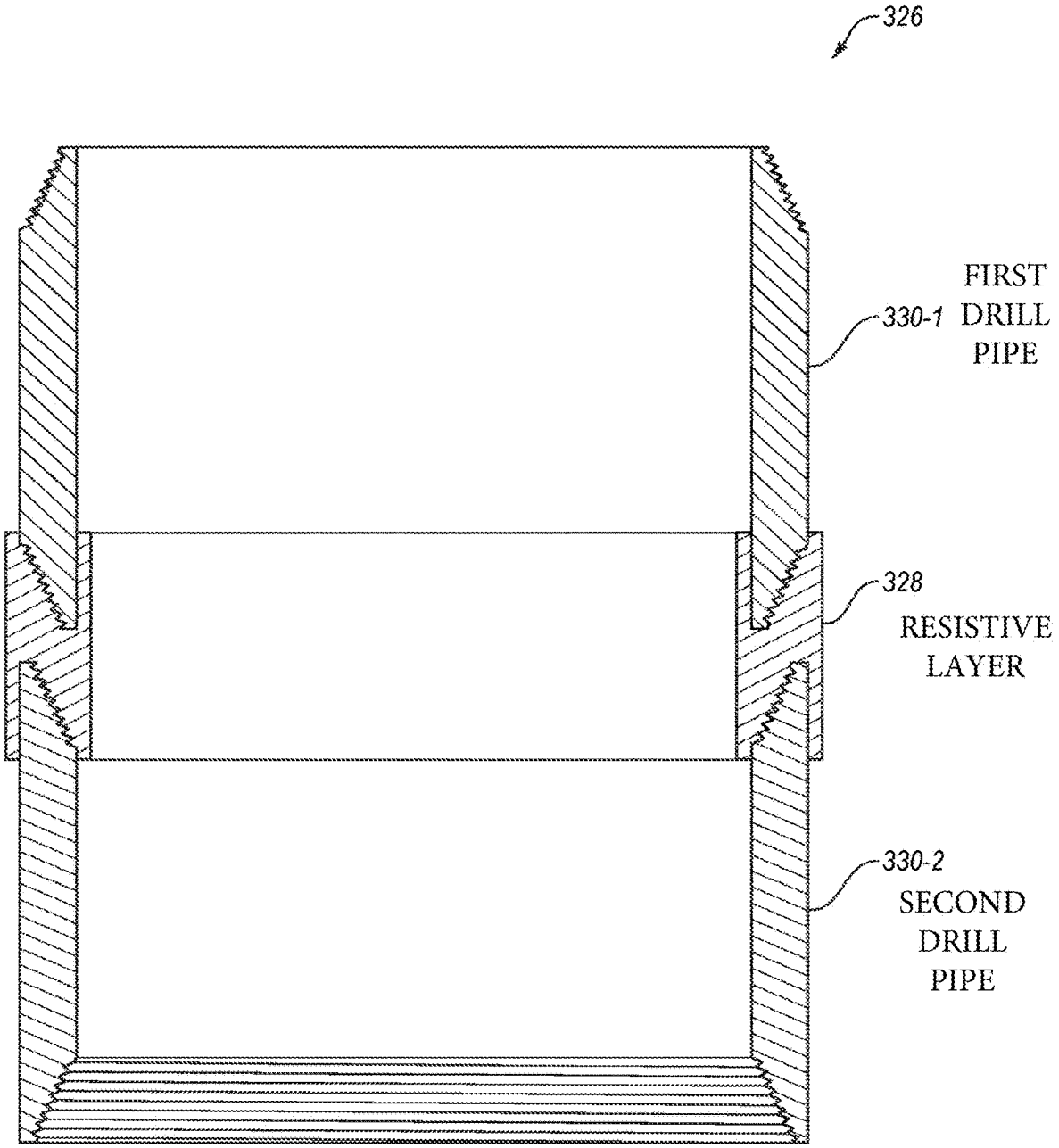
FIG. 3 is a representation of a gap sub, according to at least one embodiment of the present disclosure.

FIG. 3 is a representation of a gap sub 326, according to at least one embodiment of the present disclosure. The gap sub 326 includes a resistive layer 328 located between a first drill pipe 330-1 and a second drill pipe 330-2. The first drill pipe 330-1 and the second drill pipe 330-2 are conductive. The EM signal (e.g., EM signal 218 of FIG. 2) may be received as an electric current in one or both of the first drill pipe 330-1 and the second drill pipe 330-2. The electric potential across the resistive layer 328 may be measured, and the information encoded in the EM signal may be decoded from the electric potential.

In some embodiments, the resistive layer 328 may be threaded into the one or both of the first drill pipe 330-1 and the second drill pipe 330-2. In some embodiments, the resistive layer 328 may be bonded to one or both of the first drill pipe 330-1 and the second drill pipe 330-2, such as with an adhesive, epoxy, polymer, weld, braze, other bonding mechanism, and combinations thereof. In some embodiments, the resistive layer 328 may be connected to one or both of the first drill pipe 330-1 and the second drill pipe 330-2 with a mechanical fastener, such as a bolt, a screw, or other mechanical fastener. In some embodiments, the resistive layer 328 may be connected to one or both of the first drill pipe 330-1 and the second drill pipe 330-2 with any combination of threads, bonding material, or mechanical fastener.

Figure 4:
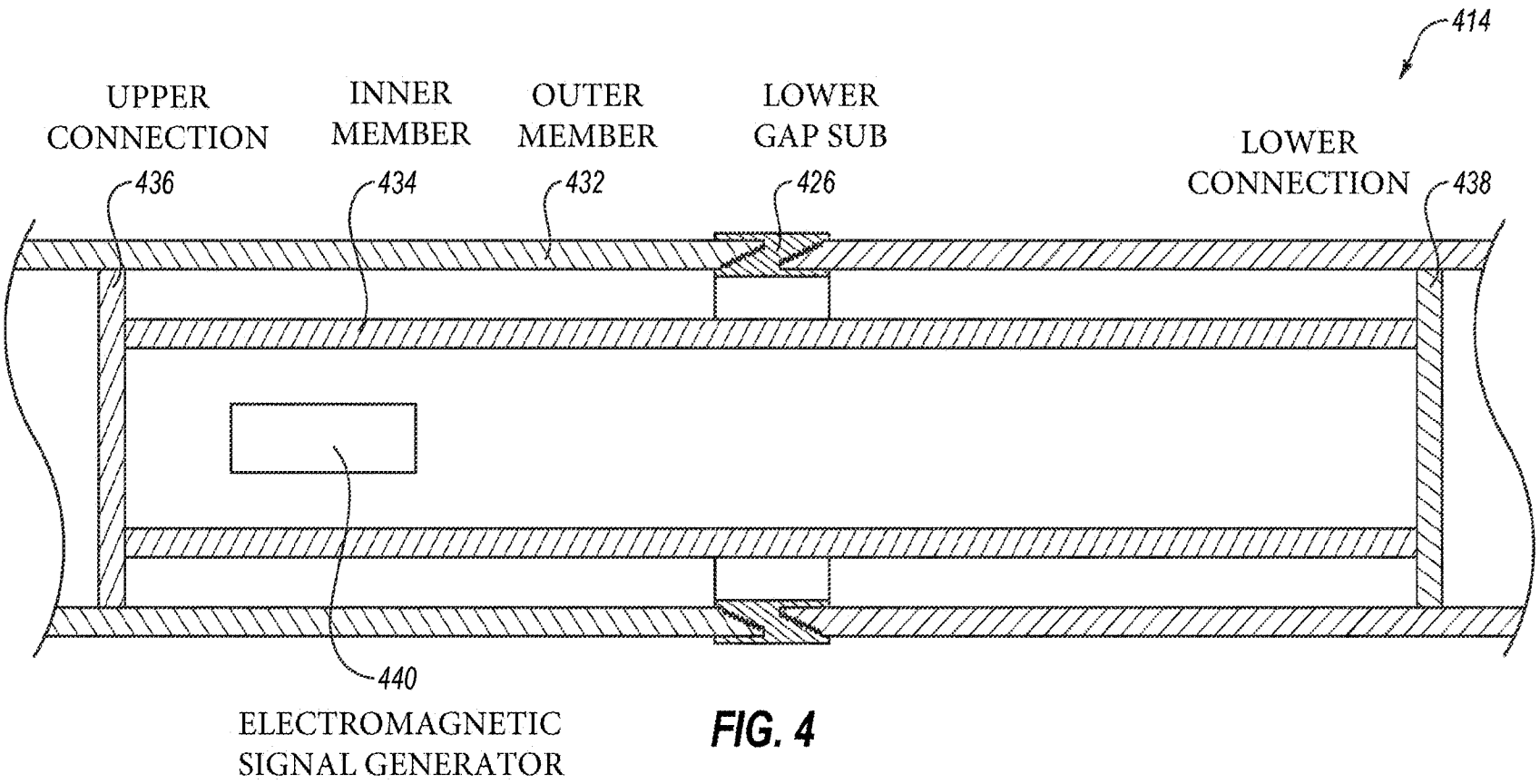
FIG. 4 is a representation of an RSS, according to at least one embodiment of the present disclosure.

FIG. 4 is a representation of an RSS 414, according to at least one embodiment of the present disclosure. The RSS 414 includes an outer member 432 (e.g., a collar, housing) and an inner member 434 (e.g., a control unit). The inner member 434 may rotate relative to the outer member 432 to maintain a geostationary position. For example, the inner member 434 may maintain a rotationally stable position with respect to an external reference, such as the force of gravity, magnetic north, true north, or other external reference.

In the embodiment shown, the outer member 432 includes a lower gap sub 426. The lower gap sub 426 may be made from an insulating material (e.g., a material having a high impedance) such that an electric current may not pass across the lower gap sub 426. By measuring the electric potential across the lower gap sub 426, an EM signal that is picked up by the drill pipe may be received. In this manner, the RSS may receive an EM downlink signal from the surface or other location. This may allow direct and high-speed communication with the RSS (e.g., direct from the surface, direct from an MWD). Direct communication with the RSS may allow an operator at the surface to send instructions to the RSS, such as directional drilling instructions, survey information, instructions to perform a measurement with a sensor, or other instructions. Sending instructions to the RSS may help the RSS to drill on a target trajectory, which may improve the drilling efficiency, thereby lowering drilling costs.

In the embodiment shown, the lower gap sub 426 may be located between the upper connection 436 and the lower connection 438. In this manner, a circuit may be broken from the lower connection 438, across the inner member 434 to the upper connection 436, and across the outer member 432 back to the lower connection 438. Breaking the circuit between the upper connection 436 and the lower connection 438 may allow the outer member 432 to function as an antenna to transmit an electromagnetic signal generated at the inner member 434. In some embodiments, the lower gap sub 426 may be located halfway between the upper connection 436 and the lower connection 438. In some embodiments, the lower gap sub 426 may be closer to the upper connection 436 or closer to the lower connection 438.

The inner member 434 may be connected to the outer member 432 with an upper connection 436 and a lower connection 438. It should be understood that references to "upper" and "lower" are not limited to up and down with respect to the gravitational force. Rather, upper and lower may refer to uphole and downhole, respectively. In this manner, the lower connection 438 may be further from a surface location than the upper connection 436.

In some embodiments, the upper connection 436 and/or the lower connection 438 may be any type of rotating connection. For clarity, the following discussion will describe the upper connection 436. However, it should be understood that the structures and connections described herein may be similarly applied to the lower connection 438, either in combination with or independently of the upper connection 436. In some embodiments, the upper connection 436 may include a bearing, such as a thrust bearing, a hanger bearing, a radial bearing, any other type of bearing, and combinations thereof.

In some embodiments, the upper connection 436 may include an electrical connection. For example, the upper connection 436 may include a rotary electrical connection, such as a slip ring or other rotary electrical connection. In this manner, an electrical circuit may be closed between the outer member 432 and the inner member 434. This may allow for communication between the outer member 432 and the inner member 434, or to utilize the outer member 432 as an antenna to transmit signals through a formation.

In the embodiment shown, the inner member 434 includes an electromagnetic signal generator 440. The electromagnetic signal generator 440 may be configured to conduct current along the inner member 434 that is transferred to the outer member 432 across the upper connection 436 and/or the lower connection 438. The current may be interrupted at the lower gap sub 426, thereby causing the outer member 432 to act as an antenna. In this manner, an EM signal may be generated at the RSS 414 and may transmit information originating at the RSS 414. For example, the EM signal may transmit into the formation, through the wellbore, or otherwise transmit to a surface location or to another gap sub in a downhole drilling assembly.

In some embodiments, the electromagnetic signal generator 440 may include an antenna. In some embodiments, the electromagnetic signal generator 440 includes an insulated gap along the inner member 434, with a switch that may selectively bridge the gap, thereby closing the circuit. In some embodiments, the switch may be located between the upper connection 436 and the lower connection 438. In some embodiments, the switch may be located at the upper connection 436 or the lower connection 438. By opening and closing the switch in a pattern, the pattern including encoded data, a signal may be generated and transmitted from the RSS 414.

Figure 5:
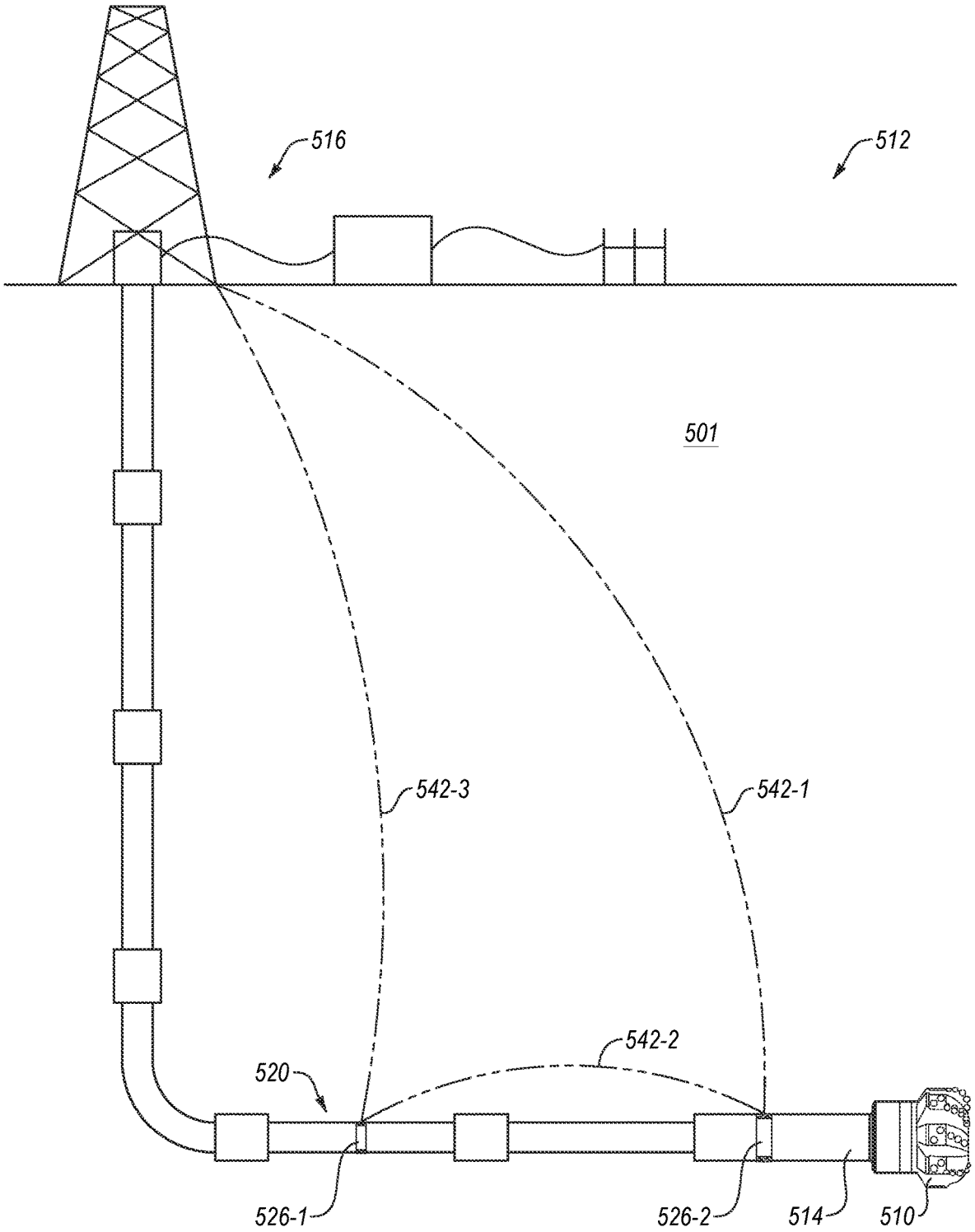
FIG. 5 is a schematic representation of another downhole communication system, according to at least one embodiment of the present disclosure.

FIG. 5 is a schematic representation of a downhole drilling system 512, according to at least one embodiment of the present disclosure. The downhole drilling system 512 includes a first gap sub 526-1 (e.g., an upper gap sub) located at an MWD 520. A second gap sub 526-2 (e.g., a lower gap sub) is located at an RSS 514. In the embodiment shown, an operator at a surface location 516 may communicate with the RSS 514 and the RSS 514 may communicate to the surface location 516 along a communication path (collectively 542).

A first communication path 542-1 may be from the surface location 516 to the second gap sub 526-2 at the RSS 514. For example, an EM signal may be generated at the surface location 516 and pass through the formation 501 to be received at the second gap sub 526-2 through EM downlink. In this manner, the operator at the surface location 516 may communicate directly with the RSS 514 via EM downlink, without any intervening communication relays, to provide steering information, instructions, and other information to the RSS 514.

In some embodiments, the RSS 514 may communicate along the first communication path 542-1 to the surface location 516. For example, the RSS 514 may include an EM signal generator, which may generate EM signals emitted at the second gap sub 526-2. The EM signals may travel through the formation 501 to the surface location 516 through EM uplink. In this manner, the RSS 514 may communicate directly to the surface location 516 via EM uplink, without any intervening communication relays.

In some embodiments, the first communication path 542-1 may be between the surface location 516 and the RSS 514. In some embodiments, the first communication path 542-1 may only include transmission from the surface location 516 to the RSS 514. In some embodiments, the first communication path 542-1 may only include transmission from the RSS 514 to the surface location 516. In some embodiments, the first communication path 542-1 may include two-way communication between the surface location 516 and the RSS 514.

In some embodiments, a second communication path 542-2 may be between the RSS 514 and the MWD 520. For example, the RSS 514 may generate an EM signal which is transmitted into the formation 501. The EM signal may be received at the first gap sub 526-1 at the MWD 520. In this manner, the RSS 514 may communicate with the MWD 520. This may allow the RSS 514 to provide the MWD 520 with information, including survey information, trajectory information, other measurements, and combinations thereof. Because the RSS 514 is closer to the bit 510 than the MWD 520, the survey measurements may be more representative of conditions at the bit 510 than measurements taken at the MWD 520. This more representative data may help improve any analyses (such as trajectory, formation properties, and so forth) performed at the MWD 520. Furthermore, the MWD 520 may compare the measurements received from the RSS 514 with its own measurements, allowing the MWD 520 to make determinations about changing wellbore conditions and perform analysis on the rate of change in dogleg and/or trajectory.

In some embodiments, the MWD 520 may communicate with the RSS 514 along the second communication path 542-2. For example, the MWD 520 may generate an EM signal using an EM signal generator. The EM signal may transmit through the formation 501 and be received at the second gap sub 526-2. In this manner, the MWD 520 may communicate with the RSS 514. This may allow the MWD 520 to provide information and/or instructions to the RSS 514. For example, the MWD 520 may communicate instructions, including trajectory instructions and/or instructions to perform measurements.

In some embodiments, the second communication path 542-2 may be between the MWD 520 and the RSS 514. In some embodiments, the second communication path 542-2 may only include transmission from the MWD 520 to the RSS 514. In some embodiments, the second communication path 542-2 may only include transmission from the RSS 514 to the MWD 520. In some embodiments, the second communication path 542-2 may include two-way communication between the MWD 520 and the RSS 514. In this manner, the MWD 520 and the RSS 514 may set up a feedback loop, where information provided by the RSS 514 is processed by the MWD 520. Instructions from the MWD 520 generated as a result of the information by the RSS 514 may be transmitted from the MWD 520 to the RSS 514. This may increase the responsiveness of the downhole drilling system 512.

A third communication path 542-3 may be between the surface location 516 and the MWD 520. In some embodiments, the surface location 516 may communicate with the MWD 520 by EM downlink. The EM signal may be received by the MWD 520 at the first gap sub 526-1. In some embodiments, the EM signal may not be received by the RSS 514 at the second gap sub 526-2. The MWD 520 may relay the surface transmission to the RSS 514 along the second communication path 542-2. For example, the MWD 520 may relay the surface transmission to the RSS 514 using EM downlink.

In some embodiments, the MWD 520 may directly rebroadcast the surface transmission. For example, the MWD 520 may pass the surface transmission on bit-for-bit (e.g., without changing the data). In some embodiments, the MWD 520 may transmit a pre-determined signal to the RSS 514 based on an analysis of the surface transmission. In some embodiments, the MWD 520 may relay the surface transmission as soon as it receives the transmission. In some embodiments, the MWD 520 may delay relaying of the surface transmission. For example, the MWD 520 may bundle several surface transmissions, or may broadcast to the RSS 514 on a schedule.

In some embodiments, the MWD 520 may communicate with the surface location 516 along the third communication path 542-3. For example, the MWD 520 may communicate with the surface using electromagnetic uplink. Accordingly, the MWD 520 may include an electromagnetic signal generator, and may transmit signals through the formation 501 that are received at the surface location 516. In some examples, the MWD 520 may communicate with the surface using any communication method, including pressure/flow rate pulses, wired pipe, wireless relays, any other communication method, and combinations thereof.

In some embodiments, because of power restraints, size restraints, and/or other restraints, the electromagnetic signal transmitted by the RSS 514 may not be strong enough to reach the surface location 516. However, the signal may travel along the second communication path 542-2 to the MWD 520. The MWD 520 may then relay the information to the surface location 516. In some embodiments, the MWD 520 may directly rebroadcast the RSS transmission. For example, the MWD 520 may pass the RSS transmission on bit-for-bit (e.g., without changing the data). In some embodiments, the MWD 520 may transmit a pre-determined signal to the surface location 516 based on an analysis of the RSS transmission. In some embodiments, the MWD 520 may relay the RSS transmission as soon as it receives the transmission. In some embodiments, the MWD 520 may delay relaying of the RSS transmission. For example, the MWD 520 may bundle several RSS transmissions, or may broadcast to the surface location 516 on a schedule.

In some embodiments, both the MWD 520 and the RSS 514 may transmit EM signals to the surface location 516. In some embodiments, the MWD 520 and the RSS 514 may transmit at separate times. For example, the MWD 520 may "listen" for a signal from the RSS 514. If the MWD 520 does not "hear" a signal from the RSS 514, then the MWD 520 may begin broadcasting. If the MWD 520 does hear a signal from the RSS 514, then the MWD 520 may not broadcast. In some examples, the MWD 520 and the RSS 514 may transmit on a schedule such that the MWD 520 and the RSS 514 do not transmit at the same time.

In some embodiments, the MWD 520 and the RSS 514 may transmit using the same frequency. In some embodiments, the MWD 520 and the RSS 514 may transmit using different frequencies. Transmitting using different frequencies may facilitate simultaneous transmission of both the MWD 520 and the RSS 514.

Figure 6:
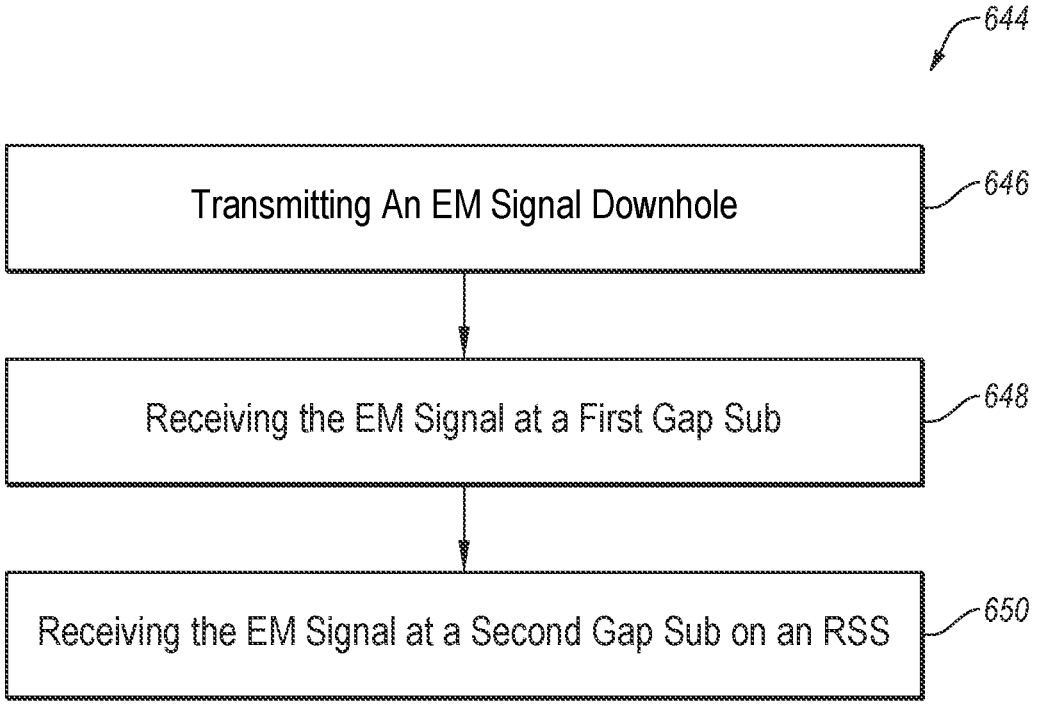
FIG. 6 is a representation of a method for downhole communication, according to at least one embodiment of the present disclosure.

FIG. 6 is a representation of a method 644 for downhole communication. The method 644 includes transmitting an EM signal downhole from a surface location at 646. The EM signal may be an EM downlink signal transmitted through the formation to be received at a downhole location. The EM signal may be received at a first gap sub downhole at 648. The EM signal may induce a current in a drill pipe. The electrical potential across the first gap sub caused by the induced current may be measured, and the information in the signal decoded. In some embodiments, the first gap sub may be located at an MWD tool, a downhole communication tool, or any other downhole tool that includes a gap sub, a sensor to measure the electric potential, and a processor to decode the signal.

The method 644 may further include receiving the EM signal at a second gap sub on an RSS at 650. The second gap sub may be located on an outer member (e.g., a collar or a housing) of the RSS. In some embodiments, the EM signal transmitted from the surface may induce an electric current in the drill string between the first gap sub and the second gap sub. The electric potential across the second gap sub may be measured, and the signal decoded.

In some embodiments, the method 644 may include the MWD relaying the EM signal from the surface to the RSS. For example, the MWD may include an electromagnetic signal generator. The MWD may generate a second EM signal that is transmitted through the formation. The drill string between the first gap sub and the second gap sub may receive the second EM signal, and the electric potential across the second gap sub may be measured.

Figure 7:
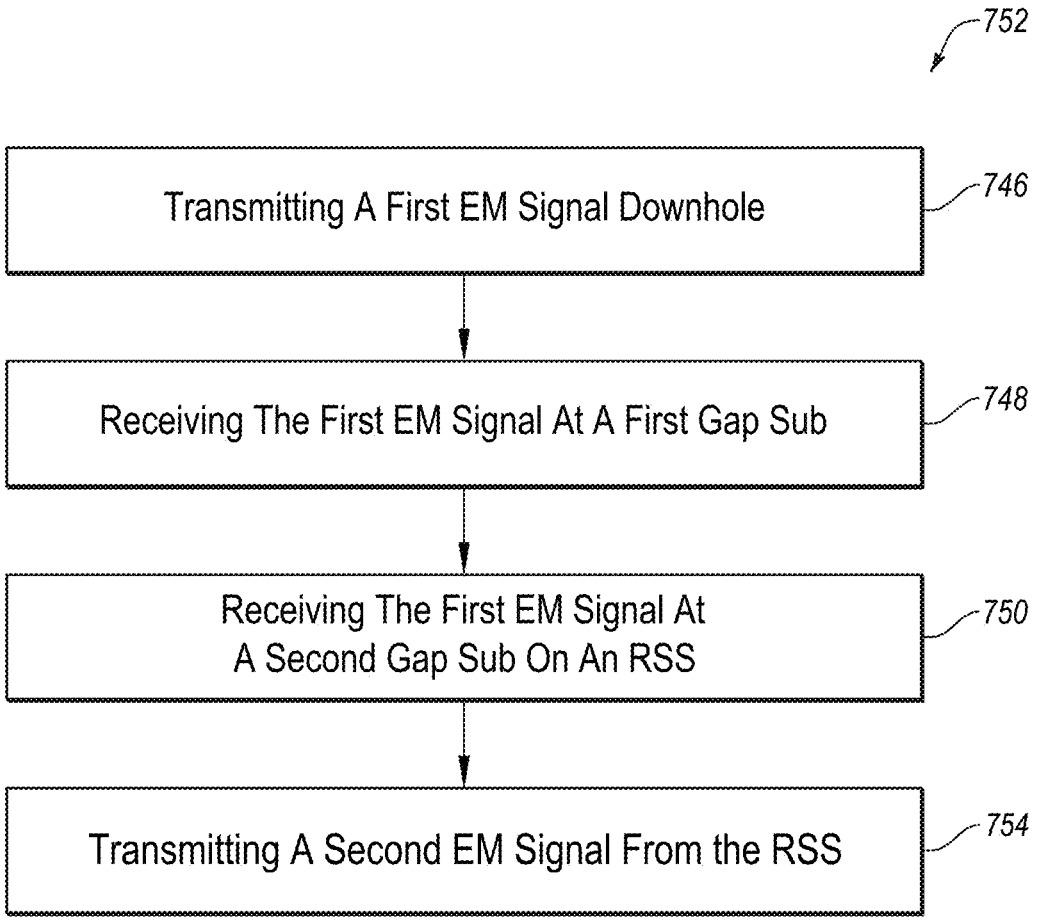
FIG. 7 is a representation of another method for downhole communication, according to at least one embodiment of the present disclosure.

FIG. 7 is a representation of a method 752 for downhole communication, according to at least one embodiment of the present disclosure. The method 752 includes transmitting a first EM signal downhole from a surface location at 746. The first EM signal may be received at a first gap sub downhole at 748. The method 752 may further include receiving the first EM signal at a second gap sub on an RSS at 750.

In some embodiments, the method 752 may include the MWD relaying the first EM signal from the surface to the RSS. For example, the MWD may include an electromagnetic signal generator. The MWD may replicate, summarize, or otherwise relay the first EM signal in a replicated first EM signal that is transmitted through the formation. The drill string between the first gap sub and the second gap sub may receive the replicated first EM signal, and the electric potential across the second gap sub may be measured.

The method 752 further includes transmitting a second EM signal from the RSS at 754. The RSS may include an RSS EM signal generator. The RSS EM signal generator may include an electric circuit across the control unit (e.g., the inner, independently rotating member). The RSS may include an upper hanger bearing and a lower hanger bearing. One or both of the upper hanger bearing and the lower hanger bearing may include a rotating electrical connection, such as electrically conductive bearings, a slip ring, or other rotating electrical connection. The second gap sub may be located between the upper hanger bearing and the lower hanger bearing. To transmit the second EM signal, the circuit is opened and closed from the outer member (where the second gap sub is located), across the upper hanger bearing, through the control unit, and across the lower hanger bearing to the outer member.

In some embodiments, the method 752 may include receiving the second EM signal at the first gap sub. In some embodiments, the method 752 may include receiving the second EM signal at the surface location. In some embodiments, the method 752 may include relaying the second EM signal. For example, the first gap sub may be located at an MWD. The MWD may include a communication module, such as an EM signal generator, a pressure/flow rate pulse generator, a wired connection, a wireless signal relay, other communication module, and combinations thereof. The MWD may relay the received second EM signal to the surface location using one or more of the communication mechanisms disclosed herein.

In some embodiments, relaying the second EM signal may include rebroadcasting the second EM signal. In some embodiments, relaying the second EM signal may include receiving the second EM signal, analyzing the second EM signal, and transmitting a pre-determined signal based on the content of the second EM signal. In some embodiments, relaying the second EM signal may include receiving a plurality of second EM signals, and waiting for a signal to relay identified information from the plurality of second EM signals.

In some embodiments, relaying the second EM signal may include processing the second EM signal before relaying at least a portion of the second EM signal. For example, the second EM signal may include trajectory information, and the MWD may analyze the trajectory information, provide a comparison to trajectory information measured at the MWD, and relay the comparison. Thus, in some embodiments, relaying the second EM signal may include any relay, rebroadcast, pass-through, summary, analysis, commentary, other processing of the second EM signal, and combinations thereof, of information contained in the second EM signal.

In some embodiments, the first EM signal and the second EM signal may be transmitted with different frequencies. Thus, transmitting the first electromagnetic signal may include transmitting the first electromagnetic signal with a first frequency. Furthermore, transmitting the second electromagnetic signal may include transmitting the second electromagnetic signal at a second frequency. The first frequency may be the same as or different from the second frequency.

In some embodiments, the first signal may be transmitted simultaneously with the second signal. In some embodiments, the first signal may be transmitted at different times than the second signal.

The embodiments of downhole communication systems have been primarily described with reference to wellbore drilling operations; the downhole communication systems described herein may be used in applications other than the drilling of a wellbore. In other embodiments, downhole communication systems according to the present disclosure may be used outside a wellbore or other downhole environment used for the exploration or production of natural resources. For instance, downhole communication systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A rotary steerable system ("RSS") comprising:
a first end:
a second end opposite the first end:
an upper connection positioned at the first end and configured to be coupled to a drill string;
a lower connection positioned at the second end:
an independently rotating inner member extending between the upper connection and the lower connection;
an outer member that at least partially surrounds the independently rotating inner member and extends between the upper connection and the lower connection; and
a gap sub located on the outer member,
wherein the independently rotating inner member includes an electromagnetic signal generator configured to create a current across the independently rotating inner member, and
wherein the current created by the electromagnetic signal generator is transferred to the outer member and interrupted by the gap sub.

2. The RSS of claim 1, at least one of the upper connection or the lower connection being electrically conductive.

3. The RSS of claim 1, the gap sub being located halfway between the upper connection and the lower connection.

4. The RSS of claim 1, the RSS further including a circuit between the outer member and the independently rotating inner member, wherein the circuit including a switch.

5. The RSS of claim 4, the switch being located across at least one of the upper connection or the lower connection of the RSS.

6. The RSS of claim 1, wherein the upper connection and the lower connection each includes a rotary electrical connection.

7. A downhole communication system, comprising:
a first gap sub;
a rotary steerable system ("RSS") positioned below the first gap sub, the RSS including,
a first end,
a second end,
an independently rotating inner member extending between the first end and the second end,
an outer member at least partially surrounding the independently rotating inner member and extending between the first end and the second end,
an upper connection located at the first end and connecting the independently rotating inner member and the outer member,
a lower connection located at the second end and connecting the independently rotating inner member and the outer member, and
a second gap sub located at the RSS and positioned on the outer member,
wherein the independently rotating inner member includes an electromagnetic signal generator configured to create a current across the independently rotating inner member, and wherein the current created by the electromagnetic signal generator is transferred to the outer member and interrupted by the second gap sub.

8. The downhole communication system of claim 7, the first gap sub being on an MWD tool.

9. A method for downhole communication, comprising:
transmitting a first electromagnetic signal downhole from a surface location;

receiving the first electromagnetic signal at a first gap sub located on an MWD tool, the MWD tool including a first electromagnetic signal generator;

relaying the first electromagnetic signal using the first electromagnetic signal generator to a rotary steerable system ("RSS") including an independently rotating inner member having a second electromagnetic signal generator and an outer member at least partially surrounding the independently rotating inner member, wherein the independently rotating inner member extend between an upper connection and a lower connection of the RSS and the outer member extend between the upper connection and the lower connection of the RSS;

receiving the relayed first electromagnetic signal at a second gap sub located on the outer member of the RSS; and transmitting a second electromagnetic signal uphole using the second electromagnetic signal generator.

10. The method of claim 9, further comprising receiving the second electromagnetic signal at the surface location.

11. The method of claim 9, further comprising receiving the second electromagnetic signal at the first gap sub.

12. The method of claim 9, further comprising:

relaying the second electromagnetic signal; and receiving the relayed second electromagnetic signal at the surface location.

13. The method of claim 9, wherein transmitting the second electromagnetic signal includes applying an electric current to the RSS.

14. The method of claim 9, wherein transmitting the first electromagnetic signal includes transmitting the first electromagnetic signal with a first frequency, and wherein transmitting the second electromagnetic signal includes transmitting the second electromagnetic signal at a second frequency, the second frequency being different from the first frequency.

15. The method of claim 9, wherein transmitting the first electromagnetic signal and transmitting the second electromagnetic signal occur at a same time.

16. The method of claim 9, wherein transmitting the first electromagnetic signal and transmitting the second electromagnetic signal occur at different times.

* * * * *